US005851001A

United States Patent [19]

Dicke et al.

[11] Patent Number: 5,851,001

[45] Date of Patent: Dec. 22, 1998

[54] DEFLECTABLE MOUNTING FOR UPRIGHT MAST

[75] Inventors: Grant D. Dicke; Jeffrey A. Williams, both of Downers Grove, Ill.

[73] Assignee: Dicke Tool Company, Downers Grove, Ill.

[21] Appl. No.: 912,901

[22] Filed: Aug. 15, 1997

[51] Int. Cl.[6] ..... F16M 13/00

[52] U.S. Cl. ..... 248/519; 40/606; 248/160

[58] Field of Search ..... 248/121, 146, 248/127, 160, 218.4, 219.2, 205.1, 519; 404/10, 6; 40/606, 612

[56] References Cited

U.S. PATENT DOCUMENTS

| | | | |
|---|---|---|---|
| 1,485,846 | 3/1924 | Griffin . | |
| 2,167,564 | 7/1939 | Fonda . | |
| 3,662,482 | 5/1972 | Sarkisian . | |
| 4,490,934 | 1/1985 | Knapp | 40/603 |
| 4,888,894 | 12/1989 | Brown, Jr. | 40/606 |
| 5,152,091 | 10/1992 | Leach | 40/603 |
| 5,318,258 | 6/1994 | Lang | 40/606 X |
| 5,551,177 | 9/1996 | Cowgill et al. | 40/603 |

FOREIGN PATENT DOCUMENTS

| | | |
|---|---|---|
| 768730 | 8/1934 | France . |
| 1181967 | 6/1959 | France . |
| 1289175 | 2/1962 | France . |
| 1 269 369 | 12/1963 | Germany . |
| 2 311 582 | 3/1973 | United Kingdom . |

*Primary Examiner*—Ramon O. Ramirez
*Attorney, Agent, or Firm*—Fitch, Even, Tabin & Flannery

[57] ABSTRACT

A sign stand provides a resilient mounting for an upstanding mast member. A composite spring extends in a vertical direction and is clamped at its top and bottom ends by respective framework members. The upper framework provides mounting for the upright mast while the lower framework provides mounting for ground-engaging legs.

7 Claims, 2 Drawing Sheets

DEFLECTABLE MOUNTING FOR UPRIGHT MAST

BACKGROUND OF THE INVENTION

1. Field of the Invention

The present invention pertains to the mounting of upright masts in a manner in which the upright masts are resiliently deflectable. More particularly, the present invention pertains to such mountings used for traffic warning and for providing notice that a worksite has been established in a given area.

2. Description of Related Art

Signs providing warnings and other information are often needed alongside paths of traffic, whether vehicular or pedestrian. Message panels conveying a suitable warning or other notice must be of a substantial size in order to attract attention. It has been observed, when such signs are located out of doors, that forces developed by wind gusts and air turbulence caused by nearby vehicles is substantial. Accordingly, it has been recognized that, by providing a resilient deflectable mounting located at the base of the sign panel it will be able to absorb at least a portion of the wind energy imparted against the surface of the sign panel, preventing overturning of the sign panel.

Various structures have been devised to accommodate temporary deflection of signs, posters and the like. For example, French Patent No. 1,181,967 discloses an upright sign post supported by a pair of resilient foldable base members. Resilient support for a poster board is shown in U.S. Pat. No. 3,662,482, and an adjustable flexible mast is shown in U.S. Pat. No. 4,309,836. In addition, deflectable mountings are shown in commonly assigned U.S. Pat. Nos. 4,863,138; 4,865,288; and 4,886,232. Although these and other arrangements have met with commercial success, improvements are continually being sought. For example, there is an increasingly popular use of folding warning devices which are compact so as to be stored in the trunk of a passenger vehicle, or otherwise made to fit in a relatively small space. Warning devices of these types are typically employed only for brief periods of time, and the occasion of their deployment oftentimes cannot be predicted in advance. For example, emergency personnel working near a roadway can benefit from traffic warning signs alerting motorists to expect a nearby emergency scene. Accordingly, it is important that warning signs be quickly and easily erected without requiring tools or special knowledge. Further, it is becoming increasingly important that such warning devices be made of light weight, low maintenance, especially non-corrosive, materials.

SUMMARY OF THE INVENTION

It is an object of the present invention to provide a sign stand assembly for warning devices.

Another object of the present invention is to provide a sign stand base providing resilient deflectable mounting of an upright mass.

A further object of the present invention is to provide a sign stand base of the above-described type which can be economically constructed form a minimal number of inexpensive parts.

These and other objects according to the principles of the present invention are provided in a sign stand assembly, comprising:

a spring strip of composite spring material extending in a generally vertical direction and having top and bottom ends with top and bottom edges, respectively;

a base member including a pair of opposed clamping members cooperating to provide a shielding for the bottom edge of the spring strip and to define a slot for receiving the bottom end of the spring strip with a compressive engagement;

a mounting member carrying a mast member and having a vertically extending mounting wall and a top wall, the mounting wall and the top wall cooperating to provide a shielding for the top edge of the spring strip;

a backing member having a vertically extending backing wall;

the mounting member further comprising a backing wall cooperating with the mounting wall to define a slot therebetween for receiving the top end of the spring strip with a compressive engagement;

first clamping means drawing said clamping members together to compressively engage the bottom end of the spring strip so as to shield the bottom edge of the spring strip from contact and so as to mount the spring strip to the base member;

second clamping means drawing said mounting wall and said backing wall together to compressively engage the top end of the spring strip so as to shield the top edge of the spring strip from contact and so as to mount the mounting member to the spring strip; and said first and said second clamping means being fixedly attached to the spring strip at a fixed spacing from each other, so that an unrestrained portion of the spring strip extends between the mounting member and the base member and is free to flex with loads applied to the mast member.

DETAILED DESCRIPTION OF THE PREFERRED EMBODIMENTS

Figure 1:
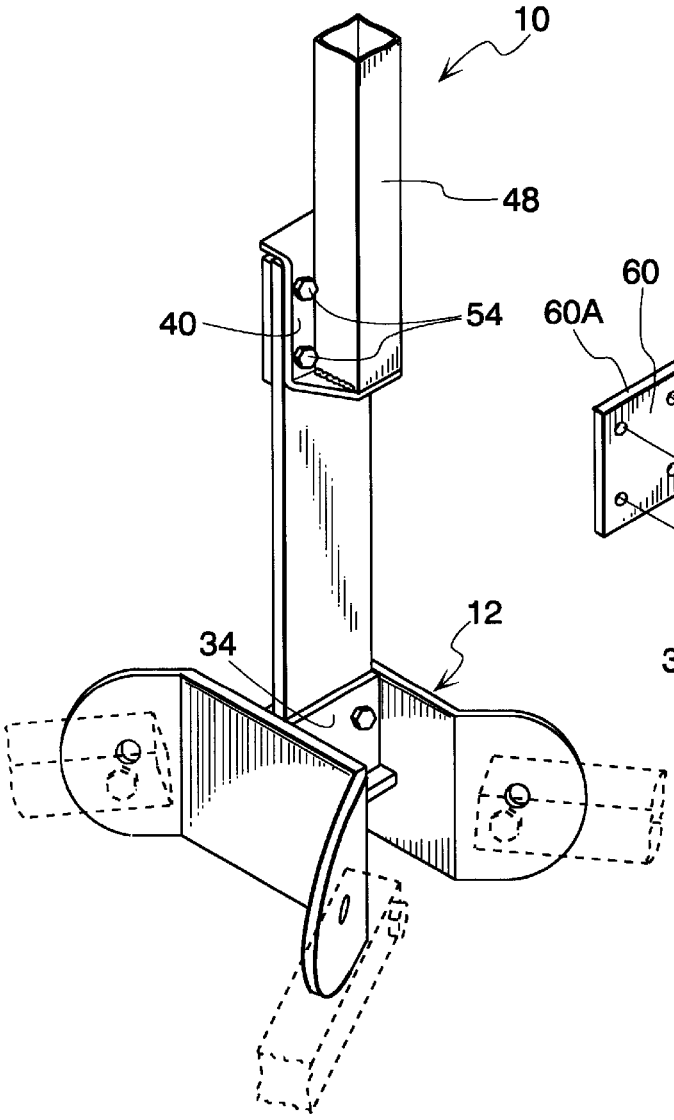
FIG. 1 is a perspective view of a sign stand assembly according to principles of the present invention.
Figure 2:
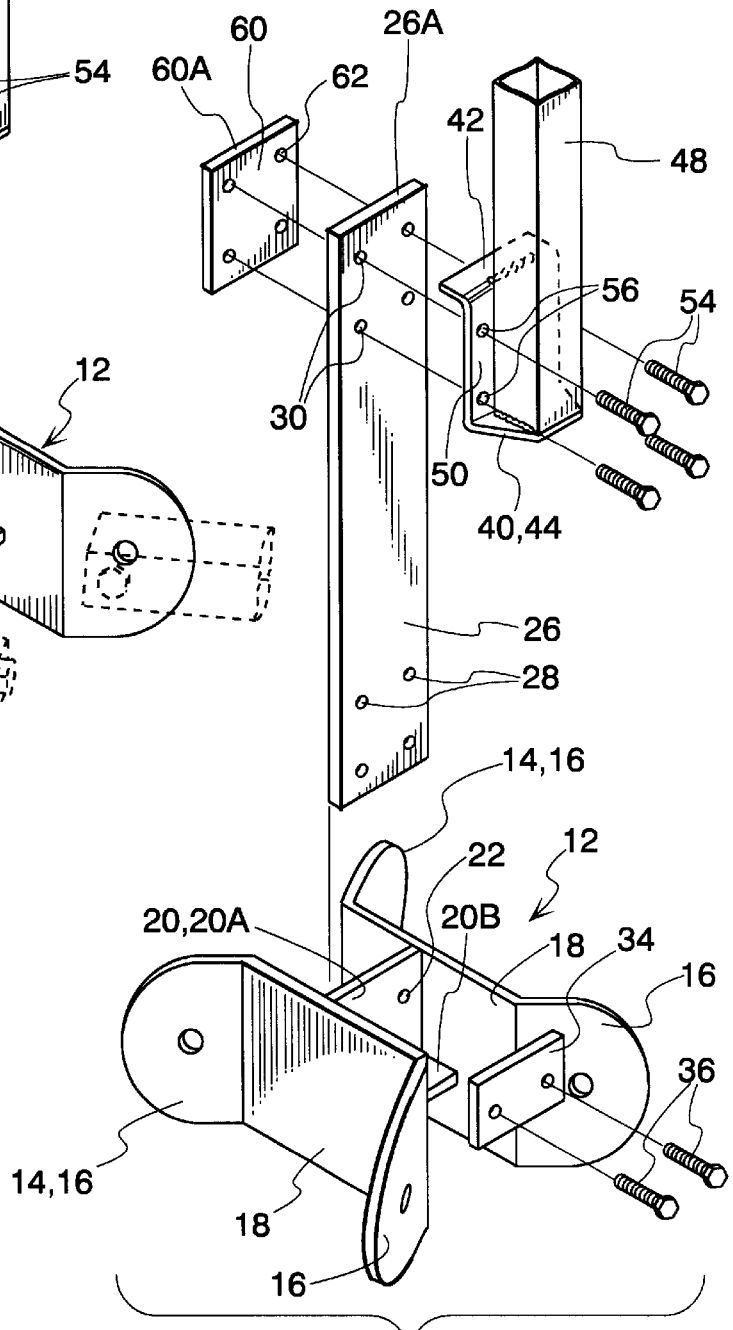
FIG. 2 is an exploded perspective view thereof.

Referring now to the drawings, and initially to FIGS. 1 and 2, a sign stand assembly is generally indicated at 10. The sign stand assembly 10 includes a mounting base generally indicated at 12. Base 12 includes a pair of opposed generally U-shaped members 14, each having a pair of legs 16 disposed on either side of a generally flat, planar mid-portion 18. Base members 14 are preferably made of metal sheet or plate which is bent at its ends to turn out the legs 16 from the plane of mid-portion 18. An L-shaped bracket, preferably of metal composition, is secured between mid-portions 18 of the opposed mounting members 14. In the preferred embodiment, the L-shaped bracket 20 is secured to mid-portions 18 by welding, although other conventional joining processes may be used. The L-shaped bracket is oriented so as to have a generally vertical portion 20*a* and a generally horizontal portion 20*b*.

A generally flat bar or strip-like spring 26 is provided with a series of holes 28 at its lower end and a series of holes 30 at its upper end. Spring 26 is made of a composite material, preferably one having non-metallic components. One important commercial example of such spring material is fiber filled plastics or resins, the most notable of which are conventional fiberglass ribs which come in a variety of cross-sectional dimensions and lengths. Generally, such ribs have a pair of opposed major faces considerably wider than the pair of remaining edge faces, and accordingly the ribs take on an elongated cross-sectional shape.

In conventional fiberglass rib construction, fiber strands extend in the longitudinal direction of the ribs, and are encased in a resin or other plastic material. In order to ensure longevity of these spring members, it has been found important to provide several safeguards against contact with the spring strips which would lead to their accelerated deterioration typically accompanied by a splitting or fraying which destroys the matrix holding the fiber strands together.

It has been found important, for example, that any exposed edges of the fibers, especially exposed formed by cutting, be shielded from abrasive contact, since contact, even if incidental, would eventually cause adjoining fibers to break away from one another and even to peel back along the length of the rib. Accordingly, it is desirable to provide a shielding of the top and bottom edges of the spring strips. Further, it has been found important to prevent inadvertent contact even with the manufactured surfaces adjacent the ends of the rib. For example, compressive blows to the sides of the rib, adjacent one end, tend to "kick out" fibers at the rib edge thus leading to deterioration of the rib integrity.

The lower end of spring 26 is secured against the vertical portion 20*a* of L-shaped bracket 20. In a preferred embodiment, the lower end of spring 26 is placed in abutting relationship with, or very close to the horizontal portion 20*b* of L-shaped bracket 20. Apertures 28 and spring 26 are aligned in registry with apertures 22 formed in the vertical portion 20*a* of L-shaped bracket 20. A compression plate 34 is placed against the remaining, exposed major face of spring 26 and threaded fasteners 36 apply a compressive force to the lower end of spring 26, pressing the spring between vertical portion 20*a* and compression plate 34. The lower end of spring 26 is received in a slot-like structure, having its exposed edges substantially completely covered by the cooperation of L-bracket 20 and plate 34 of base 12. Further, the compression forces applied to the spring are spread out over a relatively large area by the vertical portion 20*a* of L-shaped bracket 20 and the compression plate 34.

The threaded fasteners 36 pass through holes 28 in spring 26, but preferably do so conveniently to provide a compression force against major faces of spring 26, rather than to interfere with the spring 26 at points surrounding the exposed edges of holes 28. If desired, bushings made of nylon or other suitable material can be located within apertures 28 to further avoid abrasion of the exposed edges formed by the apertures, although this has been found to be unnecessary. Also, if desired, epoxy or other suitable adhesive could be employed to augment or alternatively replace the mounting force of threaded fasteners 36, although this has not been found necessary and such would add to the material and labor cost to construct the sign stand assembly.

As will be seen herein, various arrangements are provided to also shield or enclose the upper end of composite spring 26. For example, referring to FIGS. 1 and 2, a Z-shaped mounting plate 40 has upper and lower generally horizontal lips 42, 44, respectively. A mast member 48 which, like mounting plate 40, is preferably made of metal, has its lower end in contact with lip portion 44 of bracket 40 and in the preferred embodiment, is secured thereto with welding or other conventional joinder. Mast member 48 is also secured to bracket 40 by welding adjacent the upper lip portion 42. The intermediate portion 50 of bracket 40 has a relatively flat surface facing toward the upper end of composite spring 26. One major face of composite spring 26 is placed in contact with the bracket mid-portion 50 and threaded fasteners 54 are inserted through apertures 56 in bracket 50 and apertures 30 in composite spring 26. A backing plate 60 has aperture 62 for receiving threaded fasteners 54 and cooperates with mid-portion 50 of bracket 40 to compress the upper end of composite spring 26.

As can be seen in FIG. 1, the upper edge 26*a* of composite spring 26 is located immediately underneath lip portion 42 so as to be shielded thereby. Lip portion 42 is dimensioned so as to also shield the upper edge 60*a* of backing plate 60, as can be seen in FIG. 1. The backing plate 60 cooperates with the upper lip portion 42 and mid-portion 50 of bracket 40 so as to substantially enclose the entire upper end of composite spring 26. At the least, the upper edge 26*a* of the composite spring, usually formed by a cutting operation in a direction transverse to the fibers of the composite spring is protected against inadvertent contact and subsequent fraying. Further, it is generally preferred that the threaded fasteners 54 be relied upon to promote a compressive force about the upper end of composite spring 26 rather than a type of connection arising from contact of threaded fasteners 54 with the walls of composite spring 26 forming apertures 30. As with the lower end of composite spring 26, bushings of nylon or other material may be inserted in apertures 30 so as to further protect the exposed edges formed by apertures 30. An epoxy or other adhesive so as to augment the threaded fasteners 54 could also be employed, but like the use of bushings, have not been found to be necessary.

As a further precaution, it has been found important to limit the application of compressive forces to the ends of fiberglass ribs employed as major spring components, such as that contemplated in the present invention. When fiberglass ribs are employed for the sole or primary source of sign stand support, as in the present invention, it has been found that substantial compressive forces are necessary in order to securely anchor the ends of the spring rib to the various components of the sign assembly. Even when compressive forces are applied to substantial portions of the major faces of the fiberglass rib, the compressive forces, particularly in conjunction with the deflection and vibration associated with buffeting wind loadings, have been found to pose a threat to the integrity of the spring strips. Accordingly, it has been found necessary to anchor attachments to the spring strip in a permanent, nonadjustable manner, thus precluding the ability to selectably relocate fittings to the spring strips (in order to adjust the spring forces provided by the spring strips, for example). In order to maintain the integrity of the fiber matrix, even if the matrix is compromised when sufficient compressive force is applied to the ends of the spring strip, attachments to the spring strips are fixed in position and the position and the spacing of such fittings is made permanent at the time of manufacture and remains constant throughout practical, commercial use of the resulting sign stand assembly. As indicated above, the preferred manner of permanent attachment to the spring strips is to define mounting holes in the ends of the spring strip, and to pass fasteners therethrough, so as to develop compressive forces, compressively engaging the spring strip.

As described above, mast portion 48 rests upon the lower lip portion 44 of bracket 40. In this manner, the lower end of mast member 48 may be conveniently enclosed with the mast member serving as a socket for telescopic insertion of an upright mast member, if desired, Alternatively, if desired, the lower lip portion 42 can be omitted and, if necessary, the mast member 48 can be secured to bracket mid-portion 50.

Figure 3:
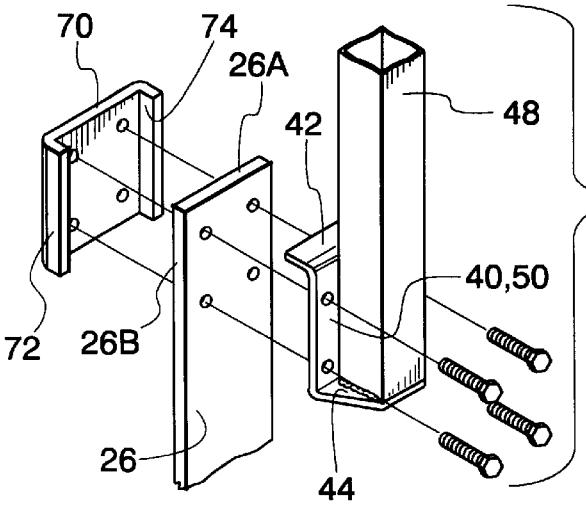
FIGS. 3 and 4 are exploded and unexploded perspective views of an alternative sign stand assembly.
Figure 4:
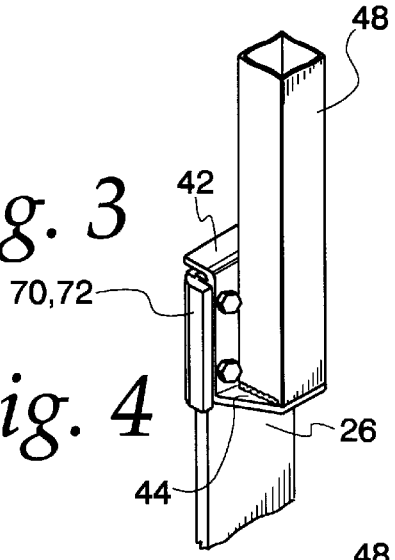

Turning now to FIGS. 3 and 4, an alternative sign stand arrangement is provided with a backing plate 60 being replaced by a generally U-shaped backing member 70. Backing member 70 has side walls 72, 74 which, as can be seen in FIG. 4, wrap around the lateral edges 26*b* of composite spring 26, and cooperating with the upper lip portion 42 of bracket 40. In the preferred embodiment, the side portions 72, 74 are dimensioned so as to overlie the exposed edges of bracket mid-portion 50. Thus, with backing member 70, the upper end of composite spring 26 can be completely enclosed. The remaining portions of the sign stand assembly remain unchanged.

Figure 5:
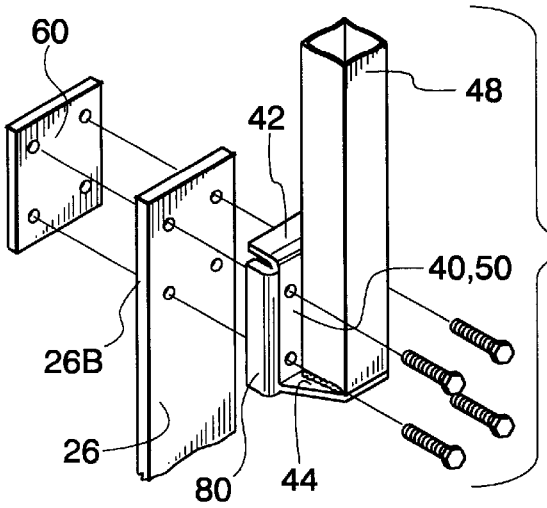
FIGS. 5 and 6 are exploded and unexploded perspective views of a further alternative sign stand assembly.
Figure 6:
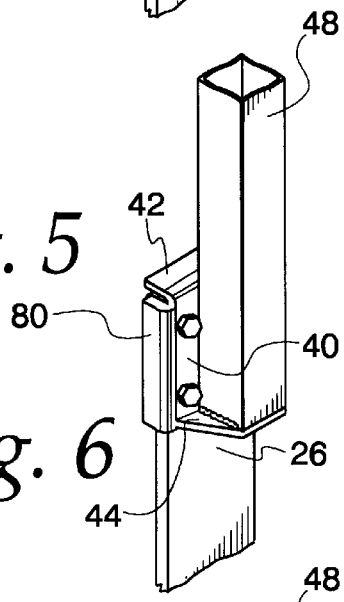

Referring now to FIGS. 5 and 6, an alternative sign stand arrangement is shown, identical to the arrangement of FIGS. 1 and 2, except that midportion 50 of bracket 40 is provided with side walls 80 which wrap around lateral edges 26*b* of composite spring 26, at can be seen in FIG. 6.

Figure 7:
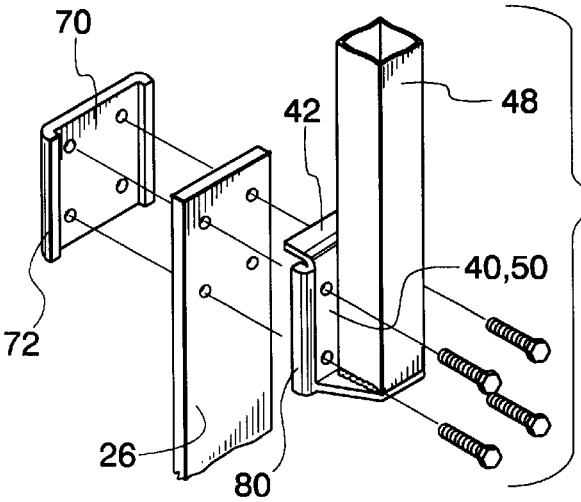
FIGS. 7 and 8 are exploded and unexploded perspective views of a further alternative embodiment of a sign stand assembly according to the principles of the present invention.
Figure 8:
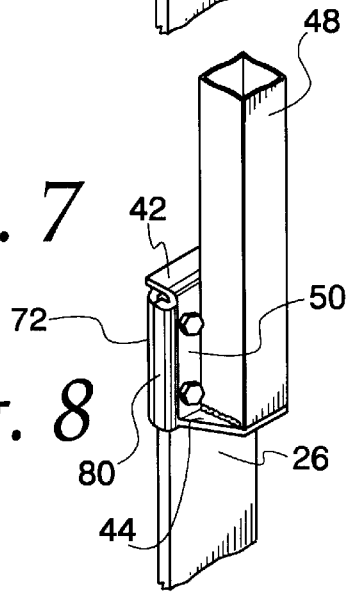

Turning now to FIGS. 7 and 8, a further alternative sign stand arrangement is shown having combined features of FIGS. 3 and 6, wherein both the central portion 50 of bracket 40 and the backing plate 70 are both provided with side wall members 80, 72, respectively. The bracket 40 and backing plate 70 can be configured such that the side walls of one fit within the other or, alternatively, the side walls have abutting vertical edges, as shown in FIG. 8. In either event, it is preferred that the bracket and backing plate and their side wall members be configured so as to completely enclose the upper end of composite spring 26.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A sign stand assembly, comprising:

a spring strip of composite spring material extending in a generally vertical direction and having top and bottom ends with top and bottom edges, respectively;

a base member including a pair of opposed clamping members cooperating to provide a shielding for the bottom edge of the spring strip and to define a slot for receiving the bottom end of the spring strip with a compressive engagement;

a mounting member-carrying a mast member and having a vertically extending mounting wall and a top wall, the mounting wall and the top wall cooperating to provide a shielding for the top edge of the spring strip;

a backing member having a vertically extending backing wall;

the mounting member further comprising a backing wall cooperating with the mounting wall to define a slot therebetween for receiving the top end of the spring strip with a compressive engagement;

first clamping means drawing said clamping members together to compressively engage the bottom end of the spring strip so as to shield the bottom edge of the spring strip from contact and so as to mount the spring strip to the base member;

second clamping means drawing said mounting wall and said backing wall together to compressively engage the top end of the spring strip so as to shield the top edge of the spring strip from contact and so as to mount the mounting member to the spring strip; and said first and said second clamping means being fixedly attached to the spring strip at a fixed spacing from each other, so that an unrestrained portion of the spring strip extends between the mounting member and the base member and is free to flex with loads applied to the mast member.

2. The assembly of claim 1 wherein the spring strip defines apertures in its top and bottom ends, and said first and said second clamping means comprise fasteners extending through the apertures and engaging the clamping members and the mounting wall and the backing wall to apply a compressive engagement to the bottom and top ends of the spring strip, respectively.

3. The assembly of claim 1 wherein said mounting member includes a bracket having an L-shaped cross-section with a top lip portion comprising said top wall and a second portion comprising said mounting wall, said top lip portion extending from the top end of said mounting wall so as to shield the top edge of said spring strip.

4. The assembly of claim 1 wherein the mast member comprises a hollow tube attached to said mounting wall.

5. The assembly of claim 1 wherein said mounting member includes a bracket defining said mounting wall and having top and bottom lip portions extending in opposite horizontal directions, on either side of said mounting wall, with the mast member comprising a hollow tube attached to said mounting wall and having a bottom end adjacent the bottom lip portion of said bracket and with the top lip portion extending from the top end of said mounting wall so as to shield the top edge of said spring strip, and said top lip portion comprising said top wall.

6. The assembly of claim 1 wherein said backing wall includes side portions extending along and facing toward said mounting wall to cooperate with the top wall and the mounting wall to enclose the top end of said spring strip.

7. The assembly of claim 1 wherein said mounting wall includes side portions extending along and facing toward said backing wall to cooperate with the top wall and the backing wall to enclose the top end of said spring strip.

* * * * *